United States Patent [19]

Jones

[11] 4,121,631

[45] Oct. 24, 1978

[54] OIL INJECTOR FOR TWO-CYCLE ENGINES

[76] Inventor: J. David Jones, 1317 Canary Dr., West Columbia, S.C. 29169

[21] Appl. No.: 770,065

[22] Filed: Feb. 18, 1977

[51] Int. Cl.[2] ..... B65B 3/10

[52] U.S. Cl. ..... 141/27; 141/98; 123/73 AD; 222/385

[58] Field of Search ..... 123/73 AD, 196; 222/129, 149, 380, 385; 141/27, 98

[56] References Cited

U.S. PATENT DOCUMENTS

| | | | |
|---|---|---|---|
| 1,491,165 | 4/1924 | Pearsons | 222/285 |
| 2,985,359 | 5/1961 | Hanje | 222/285 |
| 3,006,505 | 10/1961 | Levin | 222/285 |
| 3,523,629 | 8/1970 | Yiu Dak Chi | 222/285 |

*Primary Examiner*—Houston S. Bell

*Attorney, Agent, or Firm*—Clarence A. O'Brien; Harvey B. Jacobson

[57] ABSTRACT

An oil injector for introducing a measured quantity of lubricating oil into a predetermined quantity of gasoline for use with a two-cycle engine. The oil injector includes a tank for a supply of lubricating oil and a reciprocating pump disposed internally of the oil tank and provided with a handle located externally of the oil tank for manual manipulation with the pump being provided with a calibrated chamber to inject a predetermined quantity of lubricating oil into the gasoline supply for a two-cycle engine for each reciprocal movement of the pump piston. The oil injector is conveniently mounted alongside of or adjacent to the gasoline supply tank so that when gasoline is added to the gasoline tank, an appropriate quantity of lubricating oil may be injected into the gasoline tank by use of the oil injector, thus rendering the device especially useful for mounting on a vehicle having a two-cycle gasoline engine thereon, such as motor powered cycles, "mopeds" and the like or other vehicles and machines such as snowmobiles, lawn mowers, outboard motors, chain saws, and the like.

6 Claims, 4 Drawing Figures

Fig. 1
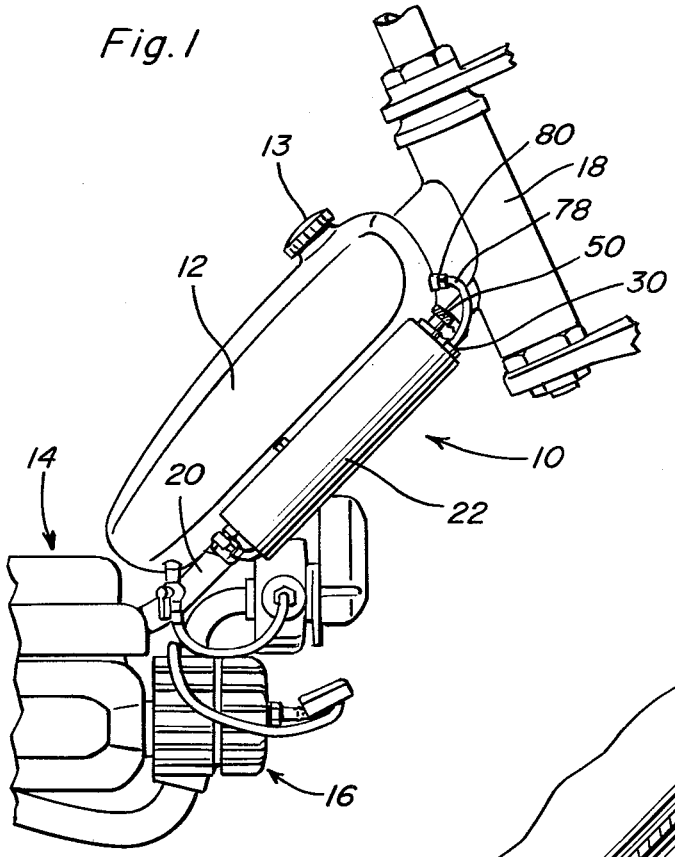
Fig. 3
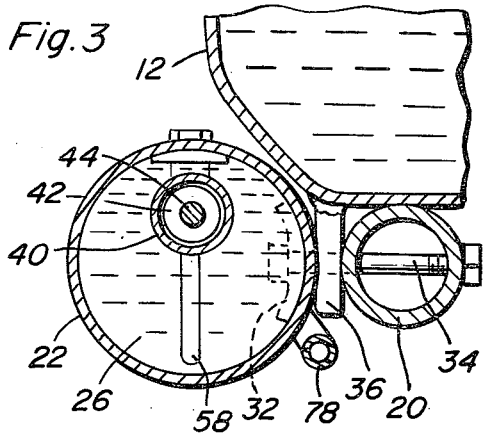
Fig. 2
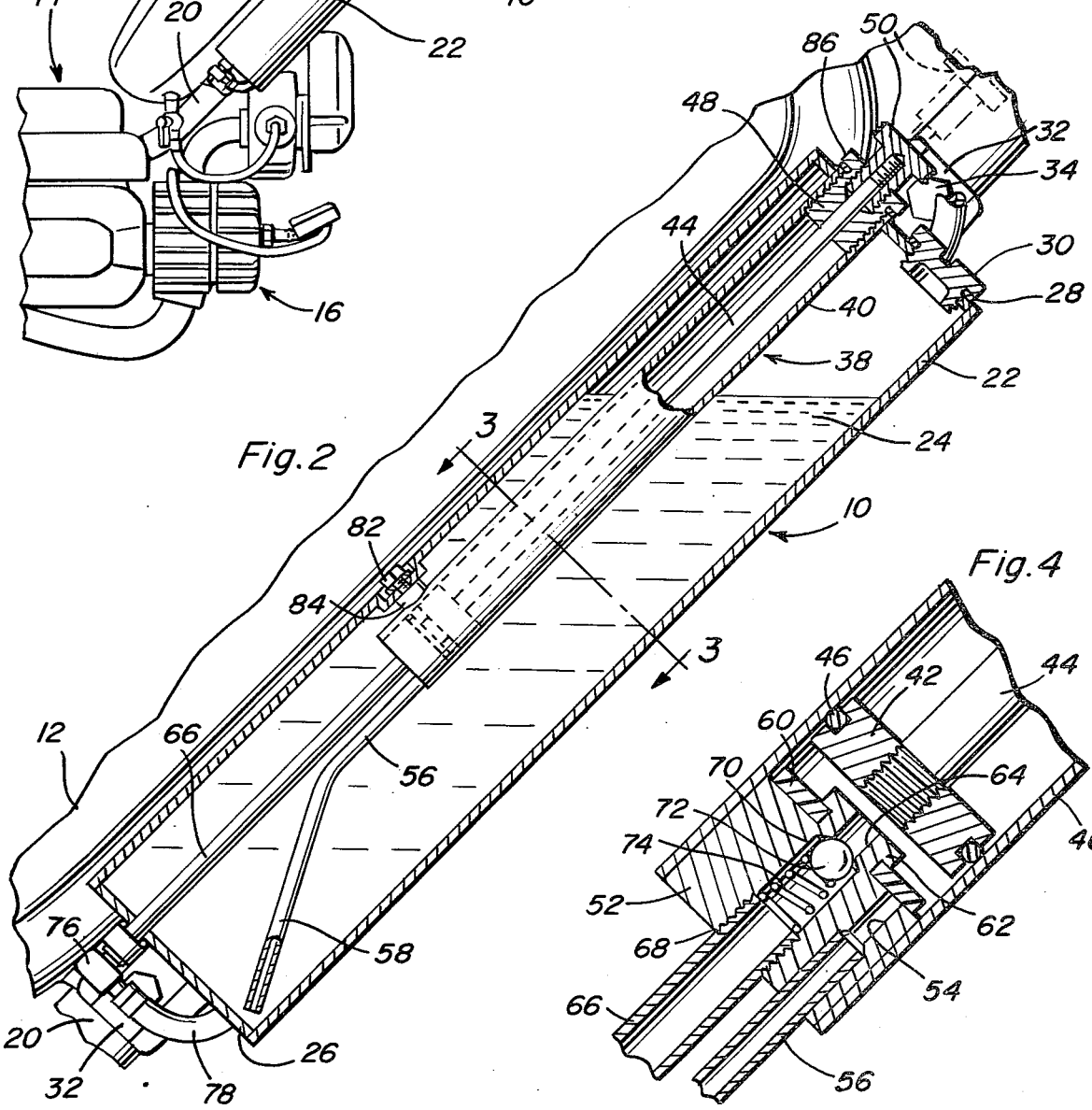
Fig. 4

OIL INJECTOR FOR TWO-CYCLE ENGINES

BACKGROUND OF THE INVENTION

1. Field of the Invention

The present invention generally relates to an oil injector for two-cycle engines in the form of a calibrated positive displacement, manually operated, reciprocated piston-type pump disposed within the confines of an oil supply tank and having a discharge communicated with a gasoline supply tank so that when a known quantity of gasoline is placed in the gasoline tank, a proportionate quantity of lubricating oil may be injected into the gasoline supply tank for mixing with the gasoline so that the desired ratio of gasoline and oil mixture will be available to the two-cycle engine for proper and efficient operation thereof.

2. Description of the Prior Art

In the operation of two-cycle engines, it is necessary that a predetermined quantity of lubricating oil be mixed with a given quantity of gasoline in order for the engine to operate efficiently and without damage. Various techniques have been utilized for this purpose, including the provision of graduated containers having calibrated scales thereon so that a predetermined ratio of oil and gasoline may be provided in a gasoline container. The art has also developed two compartment containers, with one compartment receiving a predetermined quantity of gasoline and the other compartment receiving a predetermined quantity of lubricating oil with the compartments being communicated after measurement of the liquids for proper mixing of the gasoline and lubricating oil. However, such devices usually require that the mixing of the gasoline and lubricating oil be accomplished at a point outside of the fuel supply tank normally associated with a two-cycle engine. While this is no particular problem with some devices such as lawn mowers, chain saws, and the like, which utilize two-cycle engines, it is a considerable problem when the two-cycle engine is used as the motive power for a motor powered vehicle such as motor powered bicycles, motorcycles, mini-bikes, snowmobiles and other similar vehicles.

SUMMARY OF THE INVENTION

An object of the present invention is to provide an oil injector mounted adjacent to a two-cycle engine gasoline tank which includes an oil supply tank and a positive displacement, manually operated, piston and cylinder type pump incorporated within the confines of the oil tank for injecting a predetermined quantity of lubricating oil into the gasoline supply tank of the two-cycle engine upon each reciprocal movement of the pump piston thereby enabling an accurately measured quantity of lubricating oil to be injected into the gasoline each time the gasoline tank for the two-cycle engine is filled or partially filled with gasoline.

Another object of the invention is to provide an oil injector in accordance with the preceding object in which the oil tank and pump cylinder are generally elongated cylindrical components with one end of the pump cylinder extending through one end wall of the oil tank with the pump piston including a rod having an operating handle on the external end thereof to enable manipulation of the pump externally of the oil tank.

Still another object of the present invention is to provide an oil injector in the form of a reciprocating piston-type pump having a unique structure enabling intake and discharge of lubricating oil with the components of the pump being capable of disassembly and accurately constructed for providing the discharge of a predetermined quantity of oil for each complete or partial reciprocation of the pump piston.

Yet another important object of the present invention is to provide an oil injector for a two-cycle engine in accordance with the preceding objects which may be conveniently mounted on various types of vehicles or equipment utilizing two-cycle gasoline engines as a power source with the oil injector being quite simple in operation and construction, accurate and fool-proof, long lasting and dependable.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmental, side elevational view of a portion of a motor powered bicycle illustrating the oil injector of the present invention mounted thereon in generally parallel, underlying relation to the gasoline supply tank for the two-cycle engine.

FIG. 2 is a longitudinal, sectional view of the oil injector with portions of the injector pump being shown in elevation.

FIG. 3 is a transverse, sectional view taken substantially upon a plane passing along section line 3—3 of FIG. 2 illustrating further structural details of the invention.

FIG. 4 is a fragmental. longitudinal, sectional view, taken on an enlarged scale, of the intake and discharge portions of the lubricating oil pump illustrating the structural details thereof.

DESCRIPTION OF THE PREFERRED EMBODIMENT

Referring now specifically to the drawings, the oil injector of the present invention is generally designated by reference numeral 10 and, as illustrated in FIG. 1, is mounted along side of and in generally underlying relation to a gasoline supply tank 12 mounted on a motor powered cycle generally designated by numeral 14 of the type which is powered by a two-cycle gasoline engine generally designated by numeral 16. While the type of vehicle on which the oil injector is mounted may be varied, it has particular utility with powered vehicles, such as bicycles, motor cycles, mini-bikes, snowmobiles, or the like, where gasoline would be purchased at a service station, or the like, and there would be no facilities for accurately measuring a predetermined quantity of lubricating oil. Thus, while the oil injector 10 has been illustrated in combination with a small motor cycle or motor powered bicycle, it is pointed out that it may be associated with various types of vehicles having two-cycle engines or associated with various equipment utilizing two-cycle gasoline powered engines as a power supply. As illustrated, the motor powered cycle 14 includes a front wheel and front fork supporting structure generally designated by numeral 18 and a downwardly and rearwardly inclined frame member 20 which usually supports the gasoline tank 12 and this frame member 20 constitutes a convenient manner of mounting the oil injector 10 in the position illustrated in FIG. 1 as well as in FIGS. 2 and 3 so that it will be out of the way of normal operation of the cycle but yet convenient for enabling the oil injector to be effectively used.

The oil injector 10 includes a generally cylindrical oil tank 22 receiving a quantity of lubricating oil 24 therein. The tank 22 includes a bottom end wall 26 and an upper end wall 28 with the two end walls 26 and 28 being in the form of circular plates with the upper end wall 28 including a closure plug or cap member 30 in one portion thereof enabling the supply of lubricating oil to be replenished when desired by pouring oil through the opening which receives the closure plug 30. The closure plug 30 may be vented and screw threaded or otherwise secured in position to enable easy removal thereof and also enable the plug to be replaced in sealed condition to the filler opening in the end wall 28. Also, the end walls 26 and 28 may be provided with projecting tabs or lugs 32 adjacent the peripheral edge thereof for receiving the usual mounting bolts 34 for the gasoline tank 12 which extend through the frame member 20 and depending lugs 36 on the tank 12 in order to mount the oil injector alongside of the frame member 20 and alongside of the gasoline tank 12 by merely removing and then replacing the bolts 34. It is pointed out that various means may be provided for fixedly and deteachably securing the oil injector in desired position. For example, straps encircling the oil tank 22 may be provided or any other means for attaching the oil injector to the vehicle may be provided depending upon the installational requirements.

Disposed internally of the oil tank 22 and eccentrically positioned therein is a manually operated, positive displacement, reciprocating piston-type pump 38 which includes an elongated cylinder or barrel 40 having a piston 42 reciprocating therein with the piston rod 44 attached to the piston 42 for reciprocating a piston 42. The piston 42 is provided with an O-ring seal 46 in a peripheral groove therein. The upper end of the cylinder 40 is provided with the plug 48 screw threaded into the end of the cylinder 40 and provided with a suitable seal associated therewith. The proximal end of the piston rod 44 slides through plug 48 and is provided with a knob-like handle 50 which may be a knurled knob or the like secured thereto by a screw threaded connection or the like so that manipulation of the handle 50 in a reciprocatory manner will correspondingly cause reciprocation of the piston 42 in relation to the cylinder 40. As illustrated, the handle 50 is oriented at the upper end portion of the end wall 28 so that it is in immediately accessible position adjacent the upper end portion of the gasoline tank 12 so that a person who normally places a predetermined quantity of gasoline into the gasoline tank 12 through the filler cap 13 provided thereon will be able to conventiently operate the handle 50 for injecting a predetermined quantity of lubricating oil into the gasoline tank 12. However, to provide maximum use of the volume of the oil tank 22, the orientation of the pump 38 and plug 30 may be reversed, that is, with the closure plug 30 disposed above the pump when in mounted position.

The lower end of the pump cylinder 40 is closed by a closure plug 52 having an offset inlet passageway 54 therein communicating with an intake tube 56 which has an angulated end portion 58 terminating adjacent the lowermost peripheral position of the oil tank 22 as illustrated in FIG. 2, so that when the piston 42 moves away from the plug 52, a reduced pressure area will be formed between the piston 42 and the plug 52 thereby causing intake of lubricating oil into the cylinder 40 through the intake tube 56 and inlet passageway 54. A rubber disc 60 is positioned against the inner surface of the plug 52 with a portion of the peripheral edge thereof overlying and forming a closure for the inlet passageway 54 as illustrated in FIG. 4. The rubber disc 60 is supported on a flanged projection 62 oriented centrally of the plug 52 so that the peripheral edge of the disc 60 remains flexible so that whent he piston 42 is moved away from the plug 52, the rubber disc 60 will open in the form of a flap valve thus admitting oil into the cylinder 40 through the inlet passageway 54. When outward movement of the piston 42 ceases, the inherent resiliency and flexibility of the rubber or similar disc 60 will close the inlet passageway 54, thus serving as a check valve or inlet valve for the pump.

The flanged projection 62 includes a discharge passageway 64 centrally thereof which communicates with an outlet or discharge tube 66 connected to the passageway 64 by a screw threaded connection 68, or the like. The discharge passageway 64 is provided with a shoulder 70 defining a valve seat facing the tube 66 and provided with a check valve in the form of a ball valve 72 engaged with the valve seats 70 retained resiliently against the valve seat 70 by a coil spring 74 which has one end engaging the ball valve 72 and the other end engaging the end of the discharge tube 66. The ball valve 72 closes the discharge passageway 64 when the piston 42 is moving away from the plug 52, but when the piston 42 moves toward the plug 52, the pressure exerted by the lubricating oil will force the ball valve 72 away from its seat 70, thereby enabling passage of oil through the discharge tube 66. The discharge tube 66 extends through the end wall 26 and is provided with a fitting 76 connected to a flexible hose 78 which extends to and is connected to an appropriate fitting 80 at the upper or forward end of the gasoline tank 12. It is pointed out that the specific hose arrangement and fitting arrangement may vary depending upon each installation with it only being necessary that the discharge tube 66 be communicated with the gasoline tank 12 so that the lubricating oil discharged by the pump 38 will be discharged into the gasoline tank 12. In some installations, an internal tube may be provided in the tank 12 so that very short external hoses will be necessary from the bottom of the tank 22 or pump 38 to the lower end of tank 12 with the internal tube dischanging the oil against the front wall of the tank. Also, in some installations a petcock is provided to selectively cut off the flow of gasoline to the engine. In such cases, the petcock could be modified with an additional passageway to enable oil to be injected into the gasoline tank through the petcock when in proper position.

The dimensional characteristics of the interior of the cylinder 40 and the other components of the pump are such that for each reciprocation of the piston 42 throughout its length of movement in the cylinder 40, a predetermined quantity of lubricating oil will be positively discharged into the gasoline tank 12. Thus, when a known quantity of gasoline is placed in the gasoline tank 12 at a gasoline service station, or the like, the operator of the vehicle of the service station attendant may inject a corresponding predetermined quantity of lubricating oil. For example, if the quantity of lubricating oil discharged by the pump 38 for a complete stroke of the piston 42 is calibrated to correspond with the quantity of oil that must be injected into one gallon of gasoline, it is readily apparent that for each gallon of gasoline placed in the gasoline tank, the pump handle 50 must be pulled completely out and pushed completely in. Appropriate instructional indicia may be provided on the exterior surface of the oil tank 22 and an index line or index lines may be provided on the piston rod 44 to indicate when the piston rod has been moved out of the cylinder 40 half of its distance or one quarter of its distance to enable appropriate and accurate partial strokes of the piston pump to be obtained in the event a quantity of gasoline other than an even increment of gallons is placed in the gasoline tank.

The pump 38 may be supported within the oil tank 22 in any suitable manner with a fastening bolt 82 being illustrated and extending into a threaded nut 84 rigid with the exterior of the barrel or cylinder 40 adjacent the end thereof remote from the plug 48 so that the pump 38 may be removed from the oil tank 22 for repair, replacement, or the like. Also, the handle 50 on the piston rod 44 may have external threads or partial threads on its lower end to thread into a socket in the plug 48 as at 86 in order to lock the piston 42 in its innermost position against the flanged projection 62 thus forming a positive closure for the discharge passageway 64 when the pump is inactive.

With this device attached to the vehicle, the operator of the vehicle will always have available a supply of lubricating oil and the capability of accurately injecting a predetermined and appropriate quantity of lubricating oil into the gasoline tank when he purchases gasoline from a service station, or the like. The device is dependable in operation and adds very little to the over-all weight of the vehicle and does not require the use of any extraneous tools, containers, measuring cups, mixing containers, or the like, thereby enabling the operator to more effectively operate the vehicle for a long period of time without damage to the two-cycle engine which sometimes can occur when inappropriate lubricating oil and gasoline mixture are supplied thereto.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An oil injector for two-cycle engines comprising an oil tank adapted to be mounted adjacent a gasoline tank for the engine, a cyclically operated, positive displacement pump including an inlet communicating with said oil tank and a discharge communicated with the gasoline tank, said pump being calibrated whereby each cycle of operation will discharge an accurate prededetermined quantity of oil into the gasoline tank thereby enabling an appropriate quantity of oil to be injected into the gasoline tank whenever a known quantity of gasoline is dispensed into the gasoline tank, said pump being mounted interiorly of said oil tank and including an operating means disposed externally thereof, said pump including a cylinder and reciprocal piston therein, said piston having a piston rod connected thereto and extending from one end of said cylinder and externally of the oil tank, said operating means being in the form of a knob on said piston rod, said pump cylinder including a closure plug in opposed relation to the piston, said plug including an inlet passageway and an outlet passageway therein, check valve means associated with said inlet passageway and check valve means associated with said outlet passageway, said check valve means associated with the inlet passageway including a disc of resilient material oriented with a portion overlying the inlet passageway, means anchoring the disc to the plug in spaced relation to the inlet passageway whereby inflow of oil when pressure is reduced between the plug and piston will swing the portion of the disc overlying the inlet passageway away from the inlet passageway, said disc closing the inlet passageway whenever pressure is not reduced between the plug and piston.

2. The injector as defined in claim 1 wherein said check valve means in the outlet passageway includes a ball valve spring biased to close position and openable when the piston is moved toward the plug to discharge oil into the outlet passageway, said inlet passageway including an intake tube communicated therewith and extending to the lowest portion of the oil tank, said pump discharge including tube means connected to the outlet passageway and extending externally of the oil tank for communication with the engine gasoline tank.

3. The injector as defined in claim 2 wherein said piston engages and closes the outlet passageway when in its innermost position, said knob on the piston rod including a positive but releaseable connection with the end of the cylinder remote from the outlet passageway to retain the piston in its innermost position when the pump is inoperative.

4. The injector as defined in claim 3 wherein said outlet passageway is defined partially by an inwardly extending projection centrally of said closure plug, said projection extending through said disc, and an outwardly extending flange on the end of said projection engaging the disc and retaining it on the plug with the portion overlying the inlet passageway operating as a flap type check valve during reciprocation of the piston.

5. In combination with a vehicle powered by a two-cycle gasoline engine having a fuel supply tank associated therewith, an oil injector mounted adjacent the fuel supply tank, said injector including an oil supply tank and a cyclically operated pump having a positive output volume for each cycle of operation, said pump being supported within the oil supply tank and having an inlet communicating with the bottom portion of the oil supply tank and an outlet communicating with the fuel supply tank for injecting a predetermined quantity of oil into the fuel supply tank, said pump including a manually operated handle disposed externally of the oil supply tank.

6. The combination as defined in claim 5 wherein said gasoline tank extends longitudinally of the vehicle and includes a top filler cap for replenishing the supply of gasoline, said oil supply tank extending generally longitudinally of the vehicle and including a closure plug adjacent the upper portion of the oil tank for replenishing the supply of oil, said pump including an elongated barrel having a reciprocating piston therein, a plug forming a closure for the barrel in opposed relation to the piston, said plug including an inlet passageway and an outlet passageway with the outlet passageway being centrally disposed through the plug and including a check valve closed normally but openable when the piston moves towards the plug for discharging oil, said inlet passageway being eccentrically located in the plug, and a flexible flap valve member anchored to the plug and normally disposed in overlying closed relation to the inner end of the inlet passageway with the valve member including a free edge movable away from the plug to open the inlet passageway when pressure is reduced between the plug and piston, said centrally disposed outlet passageway being closed by engagement of the piston with the inner end thereof, and means connected with the piston for manually reciprocating the piston, and means releasably retaining the piston in its innermost position in closing engagement with the outlet passageway.

* * * * *